United States Patent [19]

Willcocks

[11] Patent Number: 4,532,647

[45] Date of Patent: Jul. 30, 1985

[54] AUTOMATIC DIMENSION CONTROL FOR A DIRECTIONAL ENHANCEMENT SYSTEM

[75] Inventor: Martin E. G. Willcocks, Somersham, Great Britain

[73] Assignees: John C. Bogue, Los Angeles; Wesley Ruggles, Jr., Marina Del Ray, both of Calif.

[21] Appl. No.: 606,862

[22] Filed: May 4, 1984

Related U.S. Application Data

[63] Continuation of Ser. No. 294,242, Aug. 19, 1981, abandoned, which is a continuation of Ser. No. 166,174, Jul. 7, 1980, abandoned, which is a continuation of Ser. No. 885,958, Mar. 13, 1978, abandoned, which is a continuation of Ser. No. 779,436, May 23, 1977, abandoned, which is a continuation of Ser. No. 667,348, Mar. 16, 1976, abandoned.

[51] Int. Cl.[3] ..... H04S 3/02

[52] U.S. Cl. ..... 381/22; 381/20

[58] Field of Search ..... 381/22, 19, 20, 21, 381/23; 369/89, 88, 90

[56] References Cited

U.S. PATENT DOCUMENTS

| | | | |
|---|---|---|---|
| 3,708,631 | 1/1973 | Bauer | 179/1 GQ |
| 3,864,516 | 2/1975 | Kameoka et al. | 179/1 GQ |
| 3,883,692 | 5/1975 | Tsurushima | 179/1 GQ |
| 3,944,735 | 3/1976 | Willcocks | 179/1 GQ |

*Primary Examiner*—Douglas W. Olms

*Attorney, Agent, or Firm*—Jim Zegeer

[57] ABSTRACT

A directional enhancement system for quadrophonic sound systems wherein the improvement comprises an automatic dimension control. The automatic dimension control utilizes a plurality of limiting devices, each of which has an input terminal, an output terminal and a control terminal and is operative to limit the voltage at its output terminal to the lesser of the voltages appearing at its input terminal and its control terminal. The dimension control can also be operative to limit the maximum values of the directional control signals generated and their sums to a voltage controlled by the user of the system thereby limiting the amount of directional enhancement provided by the system.

5 Claims, 3 Drawing Figures

AUTOMATIC DIMENSION CONTROL FOR A DIRECTIONAL ENHANCEMENT SYSTEM

CROSS-REFERENCES TO RELATED APPLICATIONS

This application is a continuation of U.S. application Ser. No. 06/294,242 filed Aug. 19, 1981, which was a continuation of U.S. application Ser. No. 06/166,174 filed July 7, 1980, which was a continuation of U.S. application Ser. No. 05/885,958 filed Mar. 13, 1978, which was, in turn, a continuation of U.S. application Ser. No. 05/799,436 filed May 23, 1977, which, in turn, was a continuation of U.S. application Ser. No. 05/667,348 filed Mar. 16, 1976, all of which are now abandoned.

BACKGROUND AND SUMMARY OF THE INVENTION

This invention relates to apparatus for reproducing four separate channels of information after recording or transmission on a medium having only two tracks, and presenting it on four loudspeakers to give the listener the illusion of sound coming from a corresponding number of separate sources. In particular it refers to the directional enhancement system described in co-pending application No. 13047/74 and is intended to form part of the processing apparatus of such a system.

In the processing apparatus of the directional enhancement system, control signals produced by the direction detection apparatus are processed by imposing suitable level-limiting and attack-decay characteristics upon them, prior to generating the coefficients of a modifying matrix for presentation to the matrix multiplier of the system. When more than one such control signal occurs simultaneously, it is the purpose of the present invention to alter the level-limiting characteristics dynamically in such a way that optimum placement and separation of the corresponding sound sources is achieved. This also ensures more accurate placement and better separation for single sources in intermediate directions between those for which control signals are provided.

The invention provides method and apparatus for the processing of simultaneously present control signals arising in a directional enhancement system so as to obtain optimum placement and separation characteristics for the corresponding sound sources when reproduced on the output devices, particularly with reference to the application of directional enhancement systems to quadraphonic sound systems.

The apparatus forms part of the processor of the directional enhancement system disclosed in co-pending application No. 13047/74 and is characterised by means for limiting all such signals present to a level which depends on the number and strengths of such signals. It may also be combined with a limit-type manual dimension control.

According to one aspect the invention provides, an apparatus for enhancing the directional content of information contained in a plurality of composite signals emanating from decoding apparatus, an automatic control system comprising; a summing device having a number of inputs equal to the number of control signals provided in said directional enhancement system and an output, and operative to provide at its output a signal equal to the sum of the signals presented at its input; a plurality of dividing devices each having a first input, a second input and an output, and operative to provide at its output the quotient of the division of the first signal presented to its first input by the second signal presented to its second input, one such dividing device being provided for each of the control signals, a different one of the control signals being applied to the first input of each dividing device, and the sum signal present at the output of the summing device being applied to the second input of each dividing device; a plurality of limiting devices, each having an input, and a control terminal, and operative to prevent the signal level at its input from rising above the level at its control terminal, one such limiting device being provided for each control signal, a different one of the output signals from the dividing devices being applied to the control terminal of each limiting device, and the input of the limiting device being connected to the control signal which is also applied to the first input of the dividing device whose output is applied to the control terminal of the limiting device; the whole system being operative to limit the sum of the control signals applied to its inputs to unity, while leaving unchanged the ratios between said control signals.

In the description of the Directional Enhancement System in the co-pending application No. 13047/74 it was stated that the effect of the system was to generate the coefficients of a modifying matrix M in accordance with predetermined equations and dependent on the direction of the predominant sound source as determined by the detector apparatus of the system, and to multiply the input decoded signals vector d by this matrix M to produce the modified decoded signals vector m, thereby altering the overall transmission matrix $T_o$ so that the predominant source appears only in the corresponding loudspeaker or loudspeakers, and furthermore maintaining constant total power from the speakers for every sound source present. The process is described by the equations $$\underline{m} = M\,\underline{d} \tag{1}$$

$$= T\,\underline{s} \tag{2}$$

where T is the 4×4 transformation matrix from the original signals vector s to the modified decoded signals vector m, and $$T = MT_o \tag{3}$$

where $T_o$ is the overall transformation matrix from the original signals vector s to the decoded signals vector d presented to the input of the Directional Enhancement System. The modifying matrix can be separated into two components, $$M = B + I \tag{4}$$

where I is the identity transformation and B represents the time-varying difference between M and I which is necessary to perform the required modification. If control signals $c_\theta$ are provided for several different control directions $\theta$, the matrix B can be written as a linear combination of the corresponding predetermined matrices for each direction, $B_\theta$, and since the $c_\theta$ vary with time.

$$B(t) = \sum_{\theta} c_\theta(t) B_\theta \tag{5}$$

It was shown that if the control parameters $c_\theta$ are allowed to take intermediate values between 0 and 1 when a signal source occured between two directions for which control signals were provided, and that if the sum of the control signals was always equal to 1, the resulting modifying matrix was reasonably effective in suppressing the transferred signals and in preserving constant total power from the speakers; in particular it was shown that for a center left or center right signal complete separation and correct placement of the signal is achieved, although the total power is reduced by 1.8 dB. The effect of the invention herein described is to limit the sum of the control signals dynamically to a value close to 1, thereby achieving practically optimum separation for all single sources wherever they occur. The exact condition for complete separation of sources at any direction has been determined and is given below.

In the case of an application to the SQ quadraphonic sound system of C.B.S. Inc., a directional enhancement system was described in which six control parameters were provided and six directional modifying matrices were implemented. The direction angles $\theta$ for which control signals and modifying matrices were provided were 0° or center front, 45° or right front, 135° or right back, 180° or center back, 225° or left back and 315° or left front. The modifying matrices were designated by the subscript corresponding to the direction angle $\theta$, and the coefficients of the corresponding B matrices were given as $$B_0 = \begin{bmatrix} 0 & 0.414 & 0 & 0 \\ 0.414 & 0 & 0 & 0 \\ 0 & 0 & -0.356 & 0.644 \\ 0 & 0 & 0.644 & -0.356 \end{bmatrix} \tag{6}$$

$$B_{45} = \begin{bmatrix} -0.183 & 0 & 0 & 0 \\ 0 & 0.414 & 0 & 0 \\ 0.817 & 0 & -1 & 0 \\ 0 & 0.817 & 0 & 0.155 \end{bmatrix} \tag{7}$$

$$B_{135} = \begin{bmatrix} 0.155 & 0 & -0.817 & 0 \\ 0 & -1 & 0 & -0.817 \\ 0 & 0 & 0.414 & 0 \\ 0 & 0 & 0 & -0.183 \end{bmatrix} \tag{8}$$

$$B_{180} = \begin{bmatrix} -0.356 & 0.644 & 0 & 0 \\ 0.644 & -0.356 & 0 & 0 \\ 0 & 0 & 0 & 0.414 \\ 0 & 0 & 0.414 & 0 \end{bmatrix} \tag{9}$$

$$B_{225} = \begin{bmatrix} -1 & 0 & 0.817 & 0 \\ 0 & 0.155 & 0 & 0.817 \\ 0 & 0 & -0.183 & 0 \\ 0 & 0 & 0 & 0.414 \end{bmatrix} \tag{10}$$

$$B_{315} = \begin{bmatrix} 0.414 & 0 & 0 & 0 \\ 0 & -0.183 & 0 & 0 \\ -0.817 & 0 & 0.155 & 0 \\ 0 & -0.817 & 0 & -1 \end{bmatrix} \tag{11}$$

In order to evaluate the required combinations of these matrices to produce complete separation of sources placed elsewhere than at the corners and center front and center back positions, it will be necessary to see how these sources are encoded and decoded in the SQ system. Sources in the front and back quadrants are encoded directly according to the SQ matrix equations, but with sine and cosine functions usually provided by sine-cosine panning potentiometers. In the side quadrants these potentiometers do not provide the optimum encoding format and accordingly a position encoder has been used, which has the effect of providing signals to all four encoder inputs in accordance with equations given below. Thus, for signals between direction angles 0° and 45° the original signals vector takes the form $$\underline{s} = \begin{bmatrix} \cos(\theta + 45°) \\ \sin(\theta + 45°) \\ 0 \\ 0 \end{bmatrix} \tag{12}$$

between 45° and 135° the vector takes the form $$\underline{s} = \begin{bmatrix} \sin(\theta - 45°)(\sin(\tfrac{1}{2}(\theta - 45°)) - \cos(\tfrac{1}{2}(\theta - 45°))) \\ \cos(\theta - 45°)(\sin(\tfrac{1}{2}(\theta - 45°)) + \cos(\tfrac{1}{2}(\theta - 45°))) \\ 1.414 \sin(\theta - 45°) \cos(\tfrac{1}{2}(\theta - 45°) \\ 1.414 \cos(\theta - 45°) \sin(\tfrac{1}{2}(\theta - 45°) \end{bmatrix} \tag{13}$$

and for other directions symmetry relations exist which determine similar formats for the source signals vector. It is therefore only necessary to consider the appropriate values of the control coefficients to give complete separation of the signals in the formats given above, and to ensure that the symmetry of the system is correct, to obtain complete separation for any source position around the listener.

Consider now the requirements to be placed upon these coefficients. In the case of direction angles between 0° and 45° it is required that the only non-zero control parameters are $c_0$ and $c_{45}$, and that these should take values which are functions of the direction angle. To simplify the working, let $$c_0 = f(\theta) \tag{14}$$

and $$c_{45} = g(\theta) \tag{15}$$

Then the modifying matrix $M(\theta)$ is given by $$M(\theta) = f(\theta)B_0 + g(\theta)B_{45} + I \tag{15}$$

The decoded signals vector is given by applying the transformation matrix $T_o$ to the source signals vector s, and writing $$a = 45° - \theta \tag{16}$$

by the trigonometric identity $\cos x = \sin(90° - x)$ the source signals vector becomes $$\underline{s} = \begin{bmatrix} \sin a \\ \cos a \\ 0 \\ 0 \end{bmatrix} \tag{17}$$

and the decoded signals vector is $$\underline{d} = T_o\underline{s} = \begin{bmatrix} 1 & 0 & 0.707 & -j0.707 \\ 0 & 1 & j0.707 & -0.707 \\ 0.707 & -j0.707 & 1 & 0 \\ j0.707 & -0.707 & 0 & 1 \end{bmatrix} \begin{bmatrix} \sin a \\ \cos a \\ 0 \\ 0 \end{bmatrix} \quad (18)$$

$$= \begin{bmatrix} \sin a \\ \cos a \\ 0.707(\sin a - j\cos a) \\ 0.707(j\sin a - \cos a) \end{bmatrix}$$

Then the modified signals vector is given by $$m = Md \quad (1)$$

where $$M = \begin{bmatrix} -0.183g+1 & 0.414f & 0 & 0 \\ 0.414f & 0.414g+1 & 0 & 0 \\ 0.817g & 0 & -0.356f-g+1 & 0.644f \\ 0 & 0.817g & 0.644f & -0.356f+0.155g+1 \end{bmatrix} \quad (19)$$

and the requirement for cancellation of the signals in the rear channels means that the bottom two rows of M must form a product with d of zero. This is true of both the real and imaginary parts of these products separately, and at first sight it looks as if there would be four equations to determine two unknowns; however, two of the equations turn out to be equivalent to the other two, which leads to the two distinct equations:

$$0.644ft + 0.356f + g - 1 = 0 \quad (20)$$

$$0.644f + 0.356ft - 0.155gt - t = 0 \quad (21)$$

where t=tan a

Eliminating g between these leads to $$f = \frac{t}{0.5574 + 0.3564t + 0.0862t^2} \quad (23)$$

and eliminating f between them leads to $$g = \frac{1 - t^2}{1 + 0.6392t + 0.1547t^2} \quad (24)$$

The real and imaginary components of the two front channels of the modified signals can then be found for each direction angle, and the resulting power level calculated. Also, the placement can be found, since the reproduced signals appear only in the front two channels, and in a ratio $$t' = \tan a' = m_1/m_2 \quad (25)$$

where the reproduced direction angle $\theta'$ is given by $$\theta' = 45° - a' \quad (26)$$

The placement error is defined as the difference between the original direction angle and the reproduced direction angle, and as will be seen from Table 1, the maximum placement error in this range of source angles is 1.36°. Such an error would be barely noticeable in a direct comparison between the original signals and the reproduced signals.

The total quadraphonic separation can be defined as the ratio of the signal power in the two channels in which the signal is necessary to the correct reproduction of its direction to that in the remaining two channels, expressed in decibels. In the ideal decoding system, it would of course be infinite for all source directions at all times, but in practice this is impossible because of tolerances in components, detector performance and so on. The TQS for a simple matrix decoder calculated on the above basis is always 0 dB, hence the figure achieved in a practical decoder is a reliable indicator of the improvement achieved relative to a simple matrix decoder.

Similar reasoning to that given above for the source angle between 0° and 45° leads to the same equations for f and g in the ranges 135° to 180°, 180° to 225° and 315° to 360°, and the control parameters are related to these functions according to the equations below:

$$c_{135} = g,\ c_{180} = f,\ a = \theta - 135° \quad 135° \leqq \theta \leqq 180° \quad (27)$$

$$c_{225} = g,\ c_{180} = f,\ a = 225° - \theta \quad 180° \leqq \theta \leqq 225°$$

$$c_{315} = g,\ c_0 = f,\ a = \theta - 315° \quad 315° \leqq \theta \leqq 360°$$

In the side quadrants, the requirement for total separation is that the two components of the reproduced signals appearing on the opposite side are always zero. By similar reasoning to the above, using the source signals format given in equation (13), the values of the control signals required are given by $$d = \frac{(1 - t)(0.5774 + 0.2391t)}{0.5774 + 0.4783t + 0.0991t^2} \quad (28)$$

$$e = \frac{t(0.8165 + 0.3382t)}{0.5774 + 0.4783t + 0.0991t^2} \quad (29)$$

where t=tan a as before, and a is related to $\theta$ in the two ranges as given below:

$$c_{45} = d,\ c_{135} = e,\ a = \tfrac{1}{2}(\theta - 45°) \quad 45° \leqq \theta \leqq 135° \quad (30)$$

$$c_{225} = d,\ c_{315} = e,\ a = \tfrac{1}{2}(\theta - 225°)\ 225° \leqq \theta \leqq 315°$$

An additional useful feature of the values of d and e is that their sum is always 1. Furthermore, the sum of the values of f and g is also approximately 1, and it is therefore possible by means of comparatively simple limiting circuitry to obtain roughly the correct characteristics for the sum of the control signals. Before describing the actual circuitry required to do this, mention should be made of Table 1, in which the equations for d, e, f and g were evaluated at 5° intervals on a computer, and the resulting decoded signals were found, together with the placement, total quadraphonic separation and total effective power from the four channels. It can be seen from this table that the placement error is always less than 1.4° in the front and rear quadrants, and always less than 2.25° in the side quadrants, and the total power output varies by less than 0.25 dB in the front and rear quadrants and less than 1.9 dB in the side quadrants. Thus the overall performance of such a system is substantially perfect in these respects.

It has also been found in listening tests that the effect of this control system when more than one signal is present is to assist the correct placement of all such signals, because although the resulting control signals fall below their maximum possible values for much of the time, whenever two equal signals are present at opposite ends of the room the control circuitry then works in a manner which is preferential to neither, but still increases their separation relative to that obtained from a simple matrix decoder. This impression has been confirmed by a mathematical study of the resulting modifying matrices and their effects on sources in the principal directions for which control signals are provided. It also appears that increased separation results when three equal signals are present simultaneously. Because this system acts instantaneously, the ear is never aware that the separation of multiple sources is reduced, since whenever one source is sufficiently predominant over the others, its separation is increased to the maximum possible extent, depending on the tolerances in the components of the system.

TABLE 1

COMPUTER EVALUATION OF THE CONTROL PARAMETERS

| Source Angle $\theta$ deg. | Placement Error $\theta' - \theta$ deg. | Total Effective Power dB | Total Quadraphonic Separation dB | Control Parameters ° 0 | ° 45 | ° 135 | Sum |
|---|---|---|---|---|---|---|---|
| 0 | 0.00 | 0.00 | 99.99 | 1.0000 | 0.0000 | 0.0000 | 1.0000 |
| 5 | −0.53 | −0.07 | 99.99 | 0.9149 | 0.1799 | 0.0000 | 1.0947 |
| 10 | −0.04 | −0.13 | 99.99 | 0.8245 | 0.3346 | 0.0000 | 1.1591 |
| 15 | −1.22 | −0.18 | 81.10 | 0.7290 | 0.4693 | 0.0000 | 1.1983 |
| 20 | −1.36 | −0.21 | 78.06 | 0.6281 | 0.5876 | 0.0000 | 1.2157 |
| 25 | −1.35 | −0.23 | 76.28 | 0.5210 | 0.6923 | 0.0000 | 1.2133 |
| 30 | −1.19 | −0.23 | 76.28 | 0.4065 | 0.7850 | 0.0000 | 1.1915 |
| 35 | −0.89 | −0.19 | 74.10 | 0.2830 | 0.8670 | 0.0000 | 1.0872 |
| 40 | −0.49 | −0.12 | 72.13 | 0.1404 | 0.9387 | 0.0000 | 1.0872 |
| 45 | 0.00 | 0.00 | 70.86 | 0.0000 | 0.9394 | 0.0606 | 1.0000 |
| 50 | −0.93 | −0.31 | 70.96 | 0.0000 | 0.99394 | 0.0606 | 1.0000 |
| 55 | −1.62 | −0.62 | 71.12 | 0.0000 | 0.8806 | 0.1194 | 1.0000 |
| 60 | −2.04 | −0.90 | 71.92 | 0.0000 | 0.8234 | 0.1766 | 1.0000 |
| 65 | −2.21 | −1.16 | 72.33 | 0.0000 | 0.7676 | 0.2324 | 1.0000 |
| 70 | −2.12 | −1.39 | 72.90 | 0.0000 | 0.7128 | 0.2872 | 1.0000 |
| 75 | −1.81 | −1.58 | 73.68 | 0.0000 | 0.6539 | 0.3411 | 1.0000 |
| 80 | −1.34 | −1.72 | 73.54 | 0.0000 | 0.6056 | 0.3944 | 1.0000 |
| 90 | 0.00 | −1.84 | 73.42 | 0.0000 | 0.5000 | 0.5000 | 1.0000 |

The data presented in Table 1 refers only to the first quadrant of the source direction angle, but the remaining quadrants have symmetry relations as given above, and the given data is sufficient to show the effects of the system in all four quadrants. In particular, the total quadraphonic separation only falls from infinity because of rounding inaccuracies in the precise values of the coefficients of equations (23), (24), (28) and (29) fed to the computer, and but for these would be infinite in all directions. However, as has been mentioned, no practical system could be expected to show separation much in excess of 40 dB, due to manufacturing tolerances not only in the system but also in the hardware which provides the input signals to the system.

The above and other objects, advantages and features of the invention will become apparent when considered with the accompanying specification and drawings wherein.

DESCRIPTION OF THE PREFERRED EMBODIMENTS

Although the invention is applicable to a directional enhancement system in the context of any of a number of quadraphonic matrix systems, or for that matter to any multi-channel matrix system employing a directional enhancement system in the decoding process, it will be described in the context of a directional enhancement system operating in the decoding apparatus designed for use with the SQ quadraphonic matrix system of Columbia Broadcasting System (CBS) wherein six directional control signals are provided for the directions 0° or center front 45° or right front, 135° or right back, 180° or center back, 225° or left back and 315° or left front.

Figure 1:
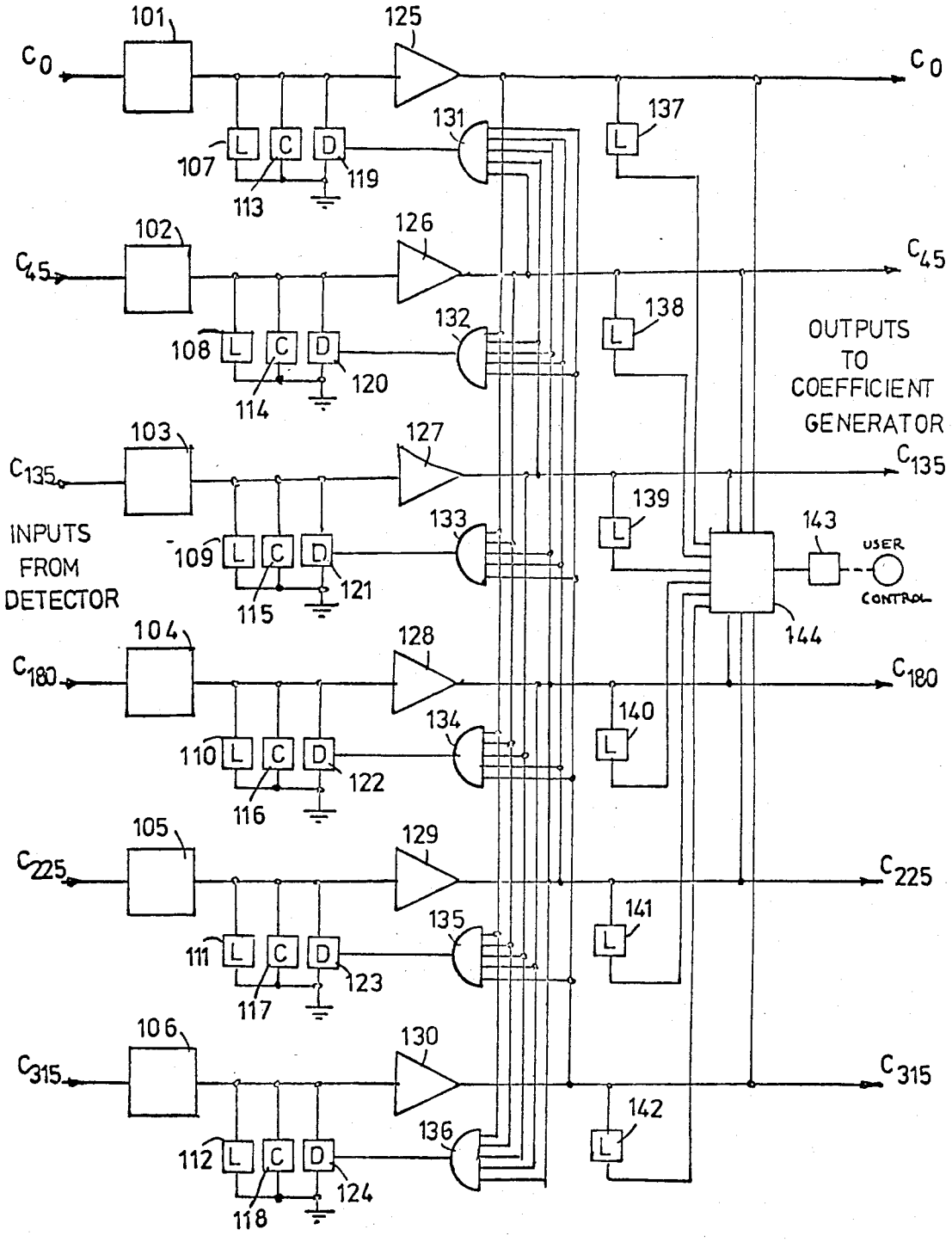
FIG. 1 is a detailed showing of the attack and decay control circuitry of the processor apparatus of the directional enhancement system according to the prior art, with the addition of an automatic dimension control section and a manual dimension control.

Referring to FIG. 1, the processor section of such a directional enhancement system, which has been described in detail in co-pending application No. 13047/74, comprises charging devices 101 through 106, limiting devices 107 through 112, charge storage devices 113 through 118, discharging devices 119 through 124, buffer amplifiers 125 through 130 and five-input OR gates 131 through 136, providing the six outputs to the coefficient generator section of the processor, which is not shown. As indicated on the Figure, additional limiting devices may be fitted at the outputs of these buffer amplifiers 125 through 130 as stated in the co-pending application and shown in FIG. 8 of that application. These limiting devices labeled 137 through 142 may further be controlled by a device labeled 143 which forms a manual dimension control, in conjunction with a device labeled 144 which represents the automatic dimension control to which this application relates.

The principles of operation of this part of the processor have been described in detail elsewhere, but the basic intention is to retain the last directional control signal received for a sufficient period of time to permit correct decoding of decaying signals, and until a further directional control signal occurs from a different direction, when the charge storage means for the original control signal is rapidly discharged. The additional purpose of the section is to limit each of the directional control signals to a standard level representing the value 1, which is applied to the coefficient generating section to generate the coefficients of the appropriate modifying matrix.

The purpose of the manual dimension control, if fitted, is to reduce the maximum separation achieved by the system, this procedure having been found desirable when such a system is reproducing particular types of performance in environments with a high level of reflected and reverberant sound. Such a manual dimension control is described in co-pending U.S. application Ser. No. 497,216, filed 5-25-83.

Figure 2:
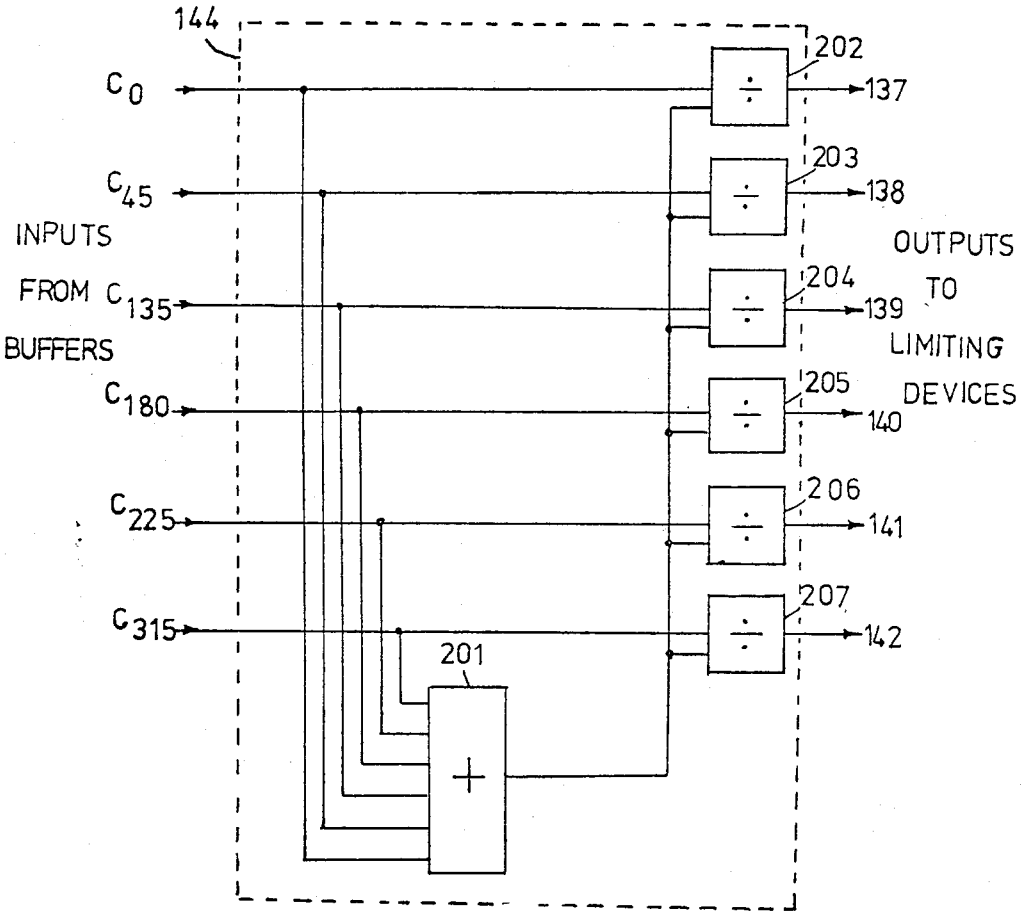
FIG. 2 is a detailed showing of the automatic dimension control section of a processor which could be employed in conjunction with the circuit of FIG. 1.

Referring now to FIG. 2, the automatic dimension control consists of a signal combiner 201 and output devices 202 through 207. In one configuration of the system, the output devices may perform a division operation on the directional control signals, effectively dividing them by the sum of their values so as to achieve the constant sum of 1 at all times. This division process produces output signals which are less than the input signals in the ratio of the total of such input signals to unity. When such output signals are applied to the additional limiting devices shown in FIGS. 1 and 2 as elements 137 through 142, they restrict the maximum excursion of each of the signals to a suitable smaller value, so that the total of the values of these control signals driving the coefficient generator is always 1.

Figure 3:
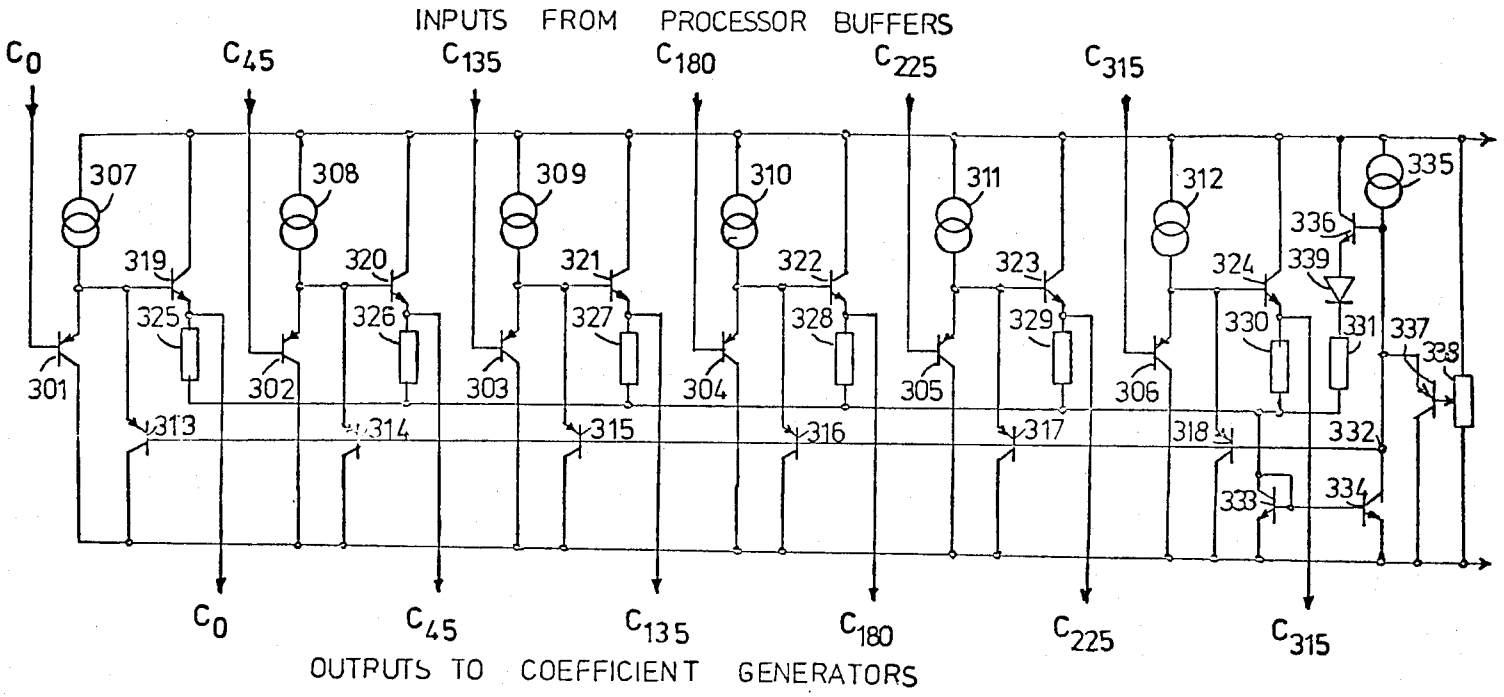
FIG. 3 is a detailed showing of a possible implementation of the automatic dimension control section of the processor together with a suitable buffer amplifier stage preceding the section and a suitable input stage for the coefficient generator following the section, showing also a manual dimension control which may be included in the circuitry.

FIG. 3 shows a simpler implementation of this system, which may have somewhat inferior performance to that of FIG. 2, but which nevertheless provides good overall characteristics. In this implementation, transistors 301 through 306 and current sources 307 through 312 constitute buffer amplifiers 125 through 130 of FIG. 1. Transistors 313 through 318 constitute the limiting devices 137 through 142 of FIGS. 1 and 2. Transistors 319 through 324, as well as being part of the automatic dimension control system, provide outputs to the coefficient generator section of the processor (not shown).

Each of resistors 325 through 331 has the same value, and they are all joined to a common summing point, 332, to which is connected the collector and base of transistor 333 and the base of transistor 334, the emitters of these transistors being grounded. Transistors 333 and 334 act as a current mirror, so that the collector current of transistor 334 is equal to the sum of the currents through resistors 325 through 331. This current is balanced against the fixed current provided by current source 335, and the voltage developed at the base of transistor 336 therefore depends on the difference between these currents. If the current through resistors 325 through 330 should fall, the voltage at the base of transistor 336 must rise, and therefore the voltage at its emitter rises also, causing the current through resistor 331 to rise by the exact amount necessary to keep the total current through resistors 325 through 331 constant and equal to that provided by current source 335.

Thus in the quiescent condition, all of transistors 319 through 324 have a low potential at their bases and do not conduct appreciable currents through resistors 325 through 330. Transistor 336 and resistor 331 therefore provide the entire balancing current necessary. When one of the control input voltages rises, say that labeled $c_0$, the associated transistor 319 also starts to conduct, and the voltage at the base of transistor 336 falls, so that the current through transistor 336 and resistor 331 falls by exactly the same amount as that by which the current through transistor 319 and resistor 325 rises. Eventually, when the voltage falls to a low enough value, transistor 313 starts to conduct and limits the voltage to which the base of transistor 319 can rise. This limit represents the unity value of the control coefficient.

Now consider the operation of the circuit when a second control input becomes activated, say that labeled $c_{45}$. In this case, transistor 320 starts to conduct, and the current through resistor 326 increases. But the current through transistor 336 has already fallen to zero in response to the signal applied to transistor 319, so that the only way in which the necessary current balance can be achieved is for the voltage at the base of transistor 313 to fall still further, and reduce the current flowing through transistor 319 and resistor 325 by the same amount as that through transistor 320 and resistor 326 increases. This process continues until transistor 314 starts to conduct, at which point each of resistors 325 and 326 conducts exactly one half of the current supplied by source 335, thus generating a voltage corresponding to control coefficients of 0.5 in each case. Similarly, when a third input is activated, the current is divided equally among three of the resistors 325 through 330, and therefore develops a coefficient of 0.333 in each case. Thus the sum of the coefficients is always limited to a maximum of 1.

In the practical case, each of transistors 319 through 324 has a non-zero base current, and so also do transistors 336 and 313 through 318. It is possible by judicious choice of the operating conditions and current gain parameters of these devices to make the sum of the coefficients exceed 1 by a specified amount when two signals are present simultaneously. Thus for example a sum of approximately 1.1 could be chosen. This would have the effect of approximating more closely to the desired characteristic described in Table 1 for sound sources in the front and rear quadrants, at the expense of worse performance at the sides. However, the performance in all directions under these conditions can be sufficiently good to give separation in excess of 15 dB in all intermediate directions. Furthermore by using different values of resistors for center front and center back inputs and by altering the value of the input voltage for these positions which corresponds to a control signal of 1, and approximation can be made to the correct performance both at the sides and at the front and rear, thereby implementing the mathematical principles of the system in full. Such other modifications and refinements as would be possible are evident, for example the value of the reference voltage fed to the comparator amplifiers of the detector section of the directional enhancement system and the gains of the said comparators may be adjusted to give the optimum performance when the system is used with an automatic dimension control.

A manual dimension control for the above system may be provided simply by adding transistor 337 to the system, and its base voltage is determined by the potentiometer 338. Diode 339 is necessary to ensure the cutoff of transistor 336 whenever others of transistors 319 through 324 are fully conducting.

I claim:

1. In a multichannel sound system having a matrix decoding apparatus and directional enhancement system for enhancing the directional content of information contained in a plurality of composite signals emanating from said matrix decoding apparatus, an automatic dimension control system comprising;

a summing device having a number of inputs equal to the number of control signals provided in said directional enhancement system and an output, and operative to produce at its output a signal proportional to the sum of the signals present at its inputs, a plurality of dividing devices each having a first input, a second input and an output, and operative to provide at its output a signal proportional to the quotient of the division of the first signal presented to its first input by the second signal presented to its second input, one such dividing device being provided for each of the control signals, a different one of the control signals being applied to the first input of each dividing device, and the sum signal present at the output of the summing device being applied to the second input of all the dividing devices in common, a plurality of limiting devices, each said limiting device having an input-output terminal means and a control terminal, and being operative to prevent the signal level at its input-output terminal means from rising above the level at its control terminal, one such limiting device being provided for each control signal, respectively, a different one of the output signals from the dividing devices being applied to the control terminal of each limiting device, and the input-output terminal means of each limiting device being connected to the first input terminal of the dividing device whose output is applied to the control terminal of the same limiting device, the said automatic dimension control system being operative to limit the maximum value of the sum of the control signals applied to its inputs to a constant value, while leaving unchanged the ratios between said control signals, thereby limiting the maximum value of the sum of the control parameters $c_\theta$ represented by said control signals to unity.

2. In a multichannel sound system having a matrix decoding apparatus and directional enhancement system for enhancing the directional content of information contained in a plurality of composite signals emanating from said matrix decoding apparatus, an automatic dimension control system comprising;

a summing device having a number of inputs equal to the number of control signals provided in said directional enhancement system and an output, and operative to produce at its output a signal proportional to the sum of the signals present at its inputs, a plurality of limiting devices, each having an input-output terminal and a control terminal, and operative to prevent the signal at its input-output terminal from rising above the level at its control terminal, one such limiting device being provided for each control signal, a different one of the control signals being applied to each of the input-output terminals of said limiting devices and the control terminals of all the said limiting devices being connected in common to the output terminal of said summing device, whereby said automatic dimension control limits the maximum value of the sum of said control signals to a constant value, thereby limiting the maximum value of the control parameters $C_\theta$ represented by said control signals to unity.

3. The directional enhancement system defined in claim 2 in which a further coupling device connected to a variable control also operates to limit the maximum output from the summing device, thereby reducing the maximum value of the sum of the control coefficients represented by said control signals to a value less than unity.

4. In a directional enhancement system for a multichannel sound system in which a processor section comprises a plurality of directional control signal generating means, each said directional control signal generating means producing a directional control signal at its output terminal and a plurality of coefficient generator means having input terminals which respond to said directional control signals which are applied thereto, the improvement comprising an automatic dimension control comprising, limiting means for automatically limiting all said directional control signals present to a level directly related to the number and strengths of such signals.

5. The directional enhancement system defined in claim 4 wherein said limiting means comprises, a plurality of limiting devices, each having a signal input terminal, a control signal input terminal and an output terminal, each said limiting device being operative to limit the voltage at its output terminal to the lesser of the voltages appearing at its input terminal and control signal voltage terminal, control means, including means for summing the signals from said directional control signal generating means and producing a control voltage proportional to the sum of said signals from said directional control generating means as said control signal applied to said control signal input terminal.

* * * * *